United States Patent [19]

Emmerich

[11] Patent Number: 4,952,001

[45] Date of Patent: Aug. 28, 1990

[54] MINING BIT PRELOAD RETAINER

[75] Inventor: Kenneth C. Emmerich, Lexington, Ky.

[73] Assignee: Fansteel Inc., North Chicago, Ill.

[21] Appl. No.: 359,844

[22] Filed: May 31, 1989

[51] Int. Cl.[5] ..... F21C 35/18

[52] U.S. Cl. ..... 299/92; 299/79

[58] Field of Search ..... 299/79, 86, 91–93; 37/142 A

[56] References Cited

U.S. PATENT DOCUMENTS

| | | | |
|---|---|---|---|
| 4,582,364 | 4/1986 | deMay, III | 299/93 X |
| 4,763,956 | 8/1988 | Emmerich | 299/92 X |

FOREIGN PATENT DOCUMENTS

| | | | |
|---|---|---|---|
| 2063965 | 6/1981 | United Kingdom | 299/92 |
| 2105768 | 3/1983 | United Kingdom | 299/79 |
| 2109438 | 6/1983 | United Kingdom | 299/79 |

*Primary Examiner*—Stephen J. Novosad
*Assistant Examiner*—David J. Bagnell
*Attorney, Agent, or Firm*—Barnes, Kisselle, Raisch, Choate, Whittemore & Hulbert

[57] ABSTRACT

A preload retainer in combination with a mining or construction bit having a shank carried in the bore of a mounting block. The retainer is a split resilient collar which snaps over a reduced neck in a tool shank and is tapered on one side to cam into a reduced diameter around the neck of the shank to pass through the bore of the mounting block. Upon reaching the operative position, the retainer expands to provide a positive lock for the bit shank. In one embodiment the retainer can be extracted by a suitable tool. In a block bore with an internal groove, the retainer expands into the groove. A hollow plug closes the inner end of the bore and serves to cam the retainer into the reduced diameter to permit removal of the shank.

6 Claims, 3 Drawing Sheets

MINING BIT PRELOAD RETAINER

FIELD OF INVENTION

Retainers for mining tool bits which are mounted on power driven machines such as large rotating wheels used in mining, excavating and earthworking.

BACKGROUND AND FEATURES OF THE INVENTION

In mining and earthworking operations, it is common to utilize replaceable cutting bits on a power driven wheel such as illustrated in a McKenry and Oaks, U.S. Pat. No. 3,720,273 (1973). It is desirable to be able to place, remove, and replace these bits quickly and easily. Devices for retaining these bits in mounting blocks have included collapsible rings of flexible material. Some of these rings are of the type which are applied to the projecting end of a bit shank after it is installed in a mounting lock as exemplified in a Emmerich U.S. Pat. No. 4,763,956 (1988). Other types include flexible retainers which can be preloaded on a bit shank and which are collapsible as they are pushed through the bore in the bit mount. These preload rings are exemplified in a deMey III U.S. Pat. No. 4,582,364 (1986) and a British patent No. 2,105,768 (published Mar. 30, 1983).

The present invention is directed to a preload type flexible retainer which can be placed on a bit prior to installation and which will retain a bit in the mount until the retainer is removed and the worn bit is replaced. The retainer of the present invention can be utilized on what is referred to as an external application where an end of the bit is exposed. Also, it may be used on an internal bit where the shank is not exposed.

The retainer is used in combination with a bit shank which will receive the retainer in collapsed condition during installation but which is designed to cooperate with the retainer in the mining operation to securely lock the bit in place until intentionally removed.

It is a further feature to provide a structure wherein the retainer can be utilized internally in a mounting block, that is, not exposed but which can be released by a seal plug which functions to protect the shank from detritus but also will serve as a release mechanism.

The objects and features of the invention are achieved by the use of a bit shank having a double diameter groove spaced inwardly from the distal end, the smaller diameter being provided to receive the collapsed retainer during installation and the larger diameter groove providing shoulder support for the expanded retainer when the bit is being used. In one embodiment a closed end tubular plug is located in the end of the opening in the mounting block to enclose that end, and the end of the tubular plug within the opening can, when projected inwardly, contract the retainer to allow removal of the bit. In each case there is a positive lock until the retainer is removed.

Other objects and features of the invention will be apparent in the following description and claims in which the principles of the invention are set forth together with details to enable persons skilled in the art to practice the invention all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
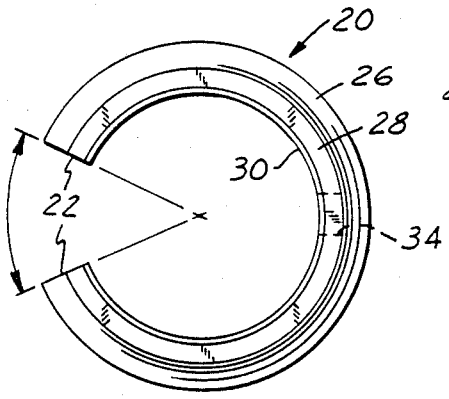
FIG. 1, an elevation of one side of a retaining ring.
Figure 2:
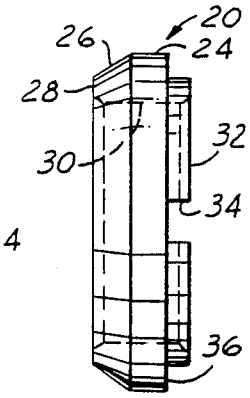
FIG. 2, an edge elevation of a retainer ring.
Figure 3:
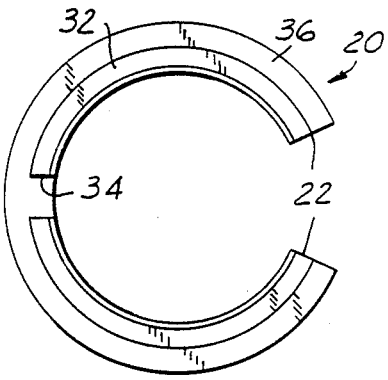
FIG. 3, an elevation of a reverse side of a retaining ring.

WITH REFERENCE TO THE DRAWINGS, in FIGS. 1, 2 and 3, a retainer ring 20 is illustrated in the form of a ring with an open gap of about 45°. The ends 22 of the gap are located on a radius so that it is wedge shaped to facilitate installation on a round shank. In cross-section, the retainer has a cylindrical body portion 24 which tapers at 26 to one flat end 28 of the retainer. The ring has a cylindrical recess 30 bell-mouthed at each end. The other end of the retainer has an ensmalled flange 32 also open at the gap and notched diamétrically opposite the gap at 34 for the reception of a removal tool as will be described. The flange 32 terminates at a radial, annular shoulder 36 extending to the outer diameter of the retainer. The material from the retainer ring will be a flexible dense plastic such as a nylon, Teflon or Celcon. An extra high molecular polyethylene with toughness and flexibility is desired.

Figure 4:
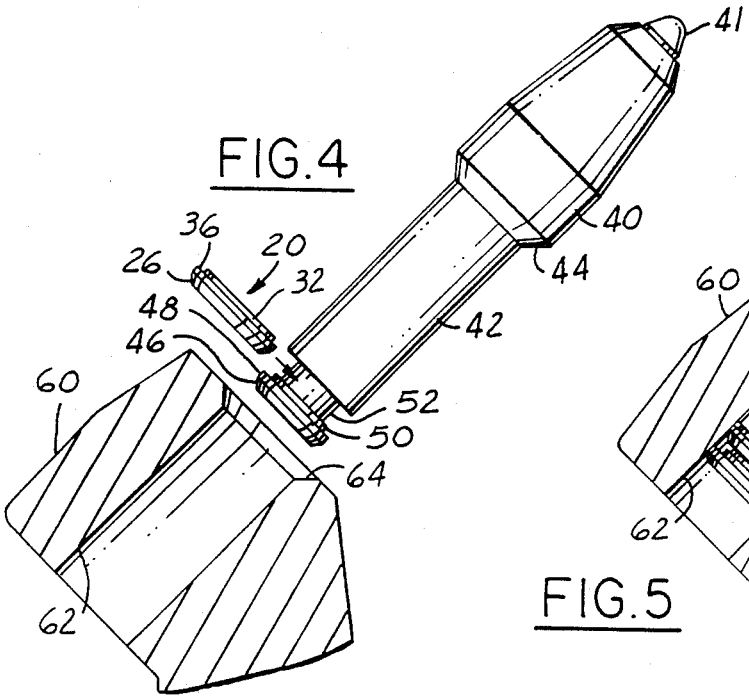
FIG. 4, a view of a bit and mounting block prior to application of the retainer ring.

FIGS. 4 to 7 illustrate consecutive phases of the use of the retainer with a specially designed mining bit and a mounting block. FIG. 4 shows the mining bit with a head portion 40 tipped with wear insert 41 of very hard material such as tungsten carbide. The retaining shank 42 is smaller in cross-section than the head 40 and terminates in a tapered shoulder 44. The distal end of the shank has a tapered rim 46 terminating at a narrow cylindrical portion 48. Spaced inwardly from the distal end is a double diameter stepped groove with a first narrow large diameter 50 and a second smaller, axially, longer groove 52. The second groove has an axial length slightly greater than the axial length of the retainer ring.

Figure 5:
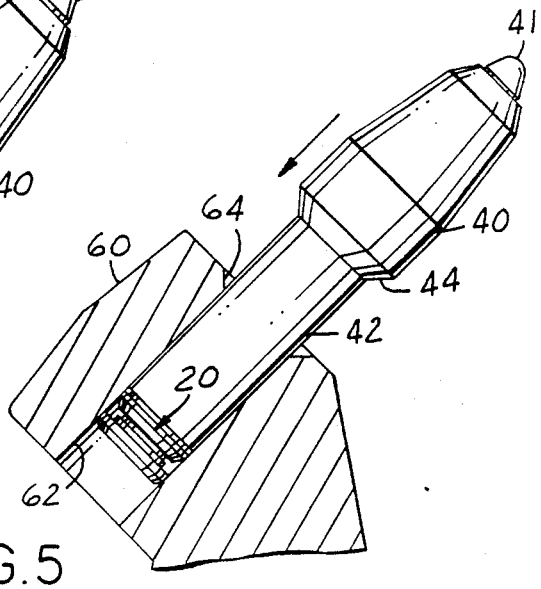
FIG. 5, a view of the bit and retainer moving through the bore in the mounting block.
Figure 6:
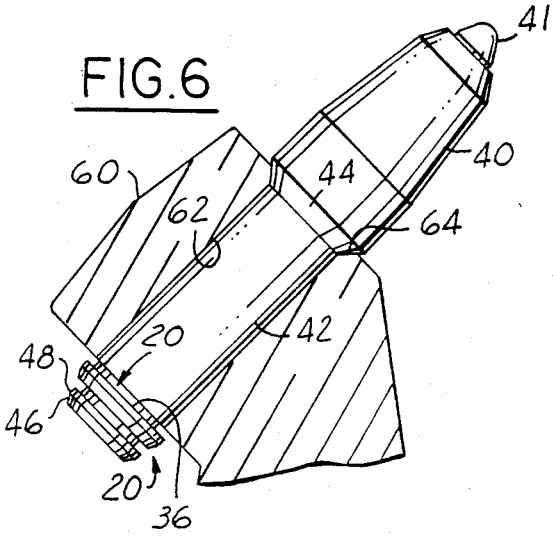
FIG. 6, a view of the bit in place for operation.

In FIG. 4, the retainer ring 20 is shown as it is preloaded onto the shank 42 of the bit. The ends 22 of the gap will engage the diameter of the groove 52 and cam open to allow the retainer to move onto the groove 52 of the shank and collapse around it. The mounting block 60 has a cylindrical receiving hole 62 with a widening throat taper 64 at the entrance end. To install the bit and preloaded retainer 20, the shank 42 is forced into the hole 62. The taper 26 on the ring engages the taper 64 at the entrance to the hole and the retainer is cammed inwardly to a smaller diameter such that it can be fully received within the groove 52. In this condition the shank, as shown in FIG. 5, is pushed into the hole 62. When the distal end reaches the end of the hole 62, the retainer expands to its original shape as illustrated in FIG. 6 to serve as a positive lock axial retainer in the mining operation. The inner diameter of the retainer has a slip fit on the larger groove 50.

When the bit tip 41 is in contact with the material being mined, it will assume the position shown in FIG. 6, the taper 44 of the bit being in contact with the tapered mouth of the hole or bore 62. When pressure of a cut is relieved by loss of contact with material, the centrifugal force will fling the bit forward to a position illustrated in FIG. 7 where the retainer serves as a positive lock. The shoulder 36 of the retainer ring contacts the inner face of the mounting block around the bore 62. Also, in this circumstance the retainer is supported internally by the groove shoulder 50. In the continued operation of the mining wheel on which the mounting blocks 60 are secured, there will be repeated severe axial shocks on the bit inward and outward. The tough retainer will insure retention of the bit until the retainer is removed.

It is important to note that the mining bit described may also be used with standard retainers if the preload retainer is not utilized.

Figure 8:
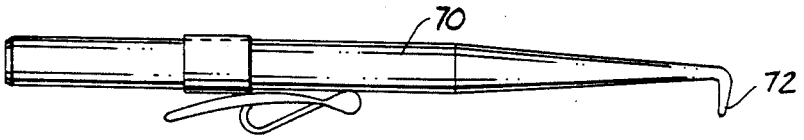
FIG. 8, a view of one embodiment of a removal tool.
Figure 9:
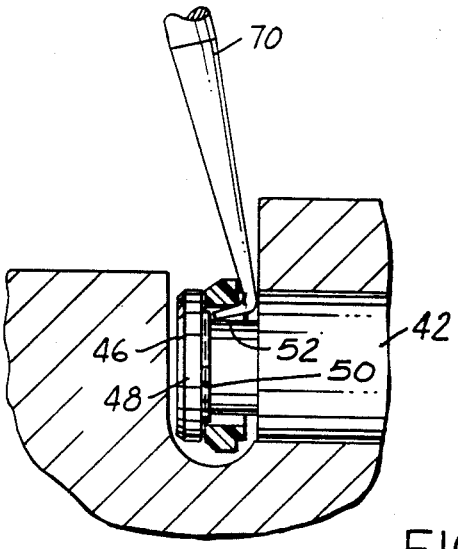
FIG. 9, a view of the removal tool engaged for retraction of a retainer ring.
Figure 10:
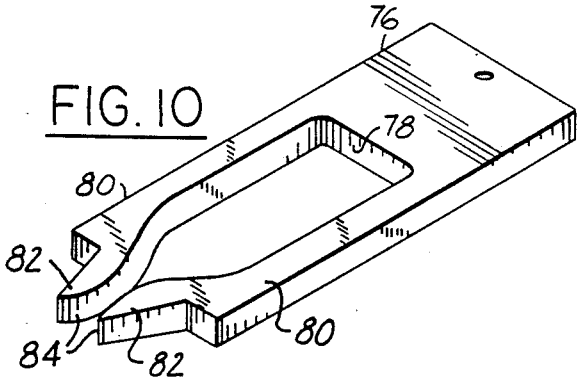
FIG. 10, a view of a modified retainer removal tool.
Figure 11:
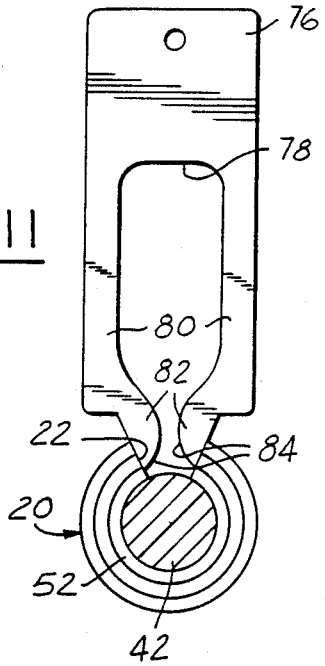
FIG. 11, a view of the removal tool in position to reject a retainer.

In FIG. 8, a removal tool 70 is illustrated with a hook portion 72. This tool can be inserted into the notch 34 as shown in FIG. 9 and the retainer ring withdrawn from the bit shank. An optional removal tool is illustrated in FIG. 10. This tool comprises a resilient plastic plate 76 having an opening 78 between two flexible arms 80. These arms terminate in curved projections 82 with diverging surfaces 84. As shown in FIG. 11, these projections will enter the gap in the retainer ring and cam the ends 22 outwardly on the inner surface of groove 52 to spread the ring and force it off the shank. The tool bit may then be readily removed from the block bore 62 and a replacement tool installed. The plastic for the tool 76 can be same as that used for the retainer.

Thus, preloading the retainer is easily and quickly accomplished and the tool shank inserted quickly. Removal is also quickly accomplished so that replacement of worn or broken tools can be done with a minimum of downtime. It will be noted that the mounting block can be standard and needs no modification to be used with the described retainer. Standard bits and sleeve bits can still be used in the mounting block. In addition, the plastic retainer need not be destroyed when removed to release the bit.

Figure 12:
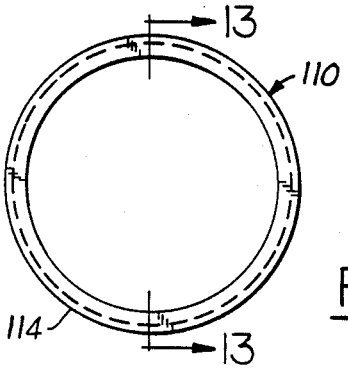
FIG. 12, an end view of tubular closure and removal plug.
Figure 13:
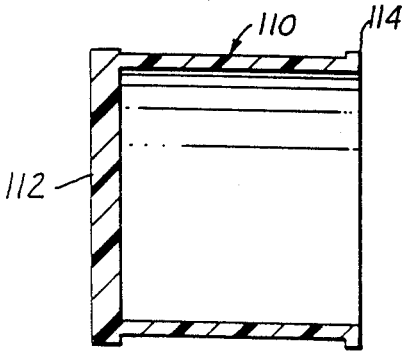
FIG. 13, a sectional view on line 13—13 of FIG. 12.
Figure 14:
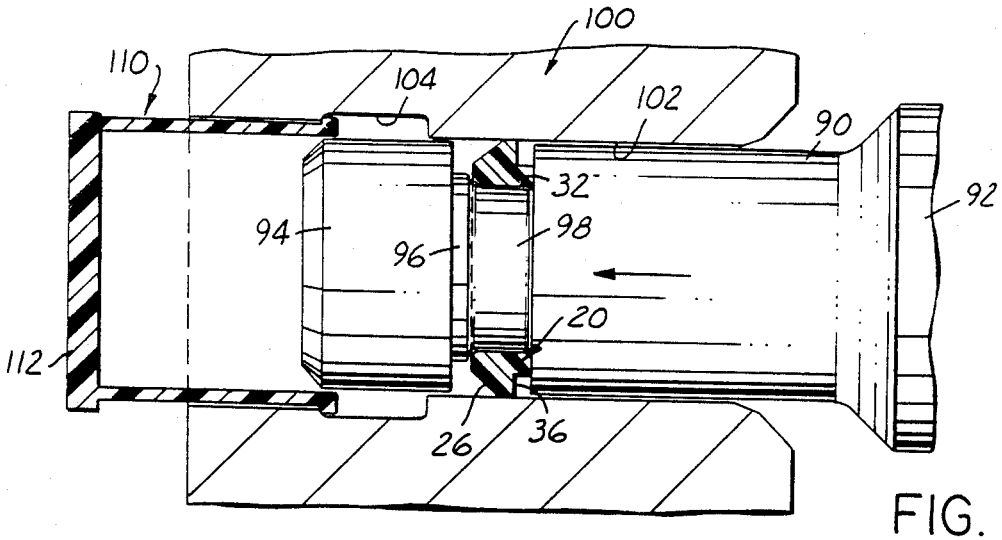
FIG. 14, a view of a tool shank insertion into an interior recess.

In FIGS. 12 to 16, a modified tool is shown which may be characterized as an internal application using the same retainer means. As shown in FIG. 14, a tool shank 90 of shorter axial dimension is used having also a taper 92 at the outer end. The cylindrical distal end 94 is also longer and the grooves 96 and 98 are provided as in the previous embodiment.

Figure 15:
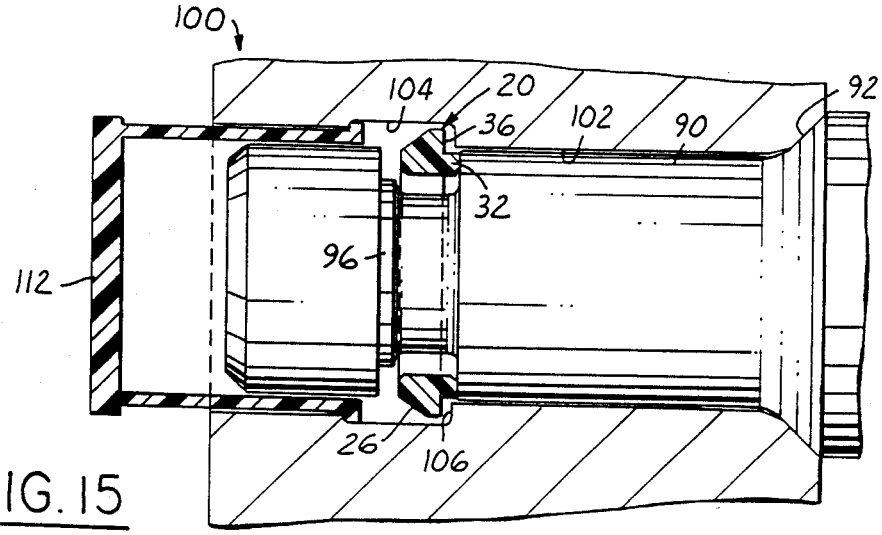
FIG. 15, a view of an installed tool shank with the closure plug in place.

The mounting block 100 has a bore 102 with an internal groove 104 to receive an expanded retainer 20. FIG. 14 illustrates the tool shank 90 with the preloaded retainer 20 being inserted in the block bore 102. When the retainer reaches the internal groove 104, it expands to the retention position as shown in FIG. 15. The shoulder 36 of the retention ring cooperates with the shoulder 106 of the groove 104 to retain the tool.

It will be noted that the groove 52 is forward of the groove 50 in FIG. 4 so that when the preloaded retainer is pushed into the bore 62, the retainer will be overlying the larger groove 52. Accordingly, when the retainer is reduced in diameter within the bore, it will be received in the groove 52 to permit the reduction in diameter to occur. The same action occurs in the embodiment in FIGS. 15 and 16.

Figure 16:
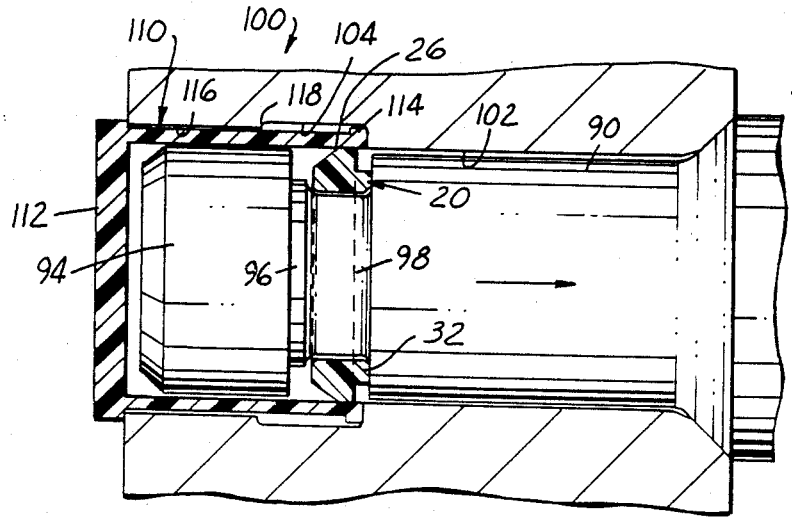
FIG. 16, a view of the closure plug in a retainer collapsing position.

A unique retainer removal structure serves also as a dust cap for the assembly This cap 110, formed of a flexible plastic, as previously described, shown in FIGS. 12 and 13, consists of a cylinder with a closed end 112 and a small external flange 114 at the other open end. The interior diameter of the cap has an easy slip fit with the exterior diameter of the bit shank 94. The flange 114 can be moved through the outer end 116 of the block bore and will expand into the groove 104 to be retained by the shoulder 118 at the end of the groove 104 and provide a positive lock during use. When it is desired to remove the bit shank from the bore 102, the cap 110 is pushed inwardly, as shown in FIG. 16, so that its inner annular end cams on the taper 26 of the ring 20 and collapses the ring so the shank 90 may be easily removed from the bore 102.

In areas where the dust and detritus are highly abrasive, this combination internal shank and dust cap ring-collapsing device is particularly useful.

Figure 7:
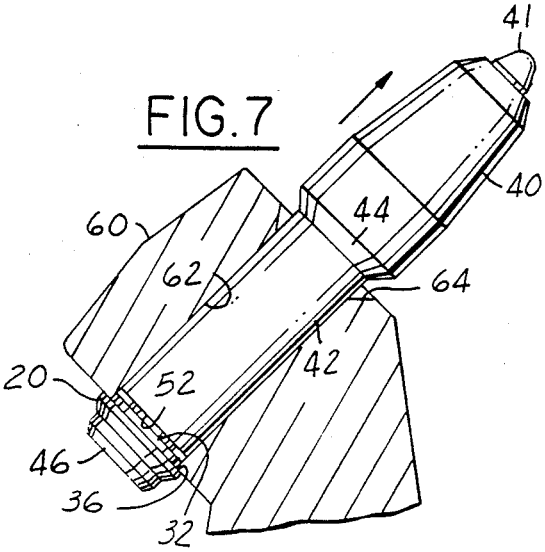
FIG. 7, a view of the bit in a throw-out position during operation.

In both embodiments the annular flange or ridge 32 functions to insert in the bore during the outward thrust of the bit, as illustrated in FIG. 7, to stabilize the retainer against expanding and loss. This feature is illustrated also in U.S. Pat. No. 4,763,956 above referenced. Similarly, the shoulder at the large groove 50 in FIGS. 4 to 7 or at 96 in FIGS. 14 to 16 centers and supports the retainer internally when the bit is flung outwardly in operation.

What is claimed is:

1. In combination a bit and preload retainer means for mining and construction which comprises:

(a) a mounting block having a receiving bore, (b) a bit having a cutting end and having a mounting shank to be received in the bore of the block and having an annular first groove forming a neck portion on the end of the mounting shank, said bit having a radial surface at the cutting end to limit the inward movement of said bit in a cutting phase, the retainer limiting the outward movement of the bit in a non-cutting phase but permitting axial motion inward and outward within said bore between said phases, (c) said preload retainer comprising:

a generally circular, resilient body with an inner face and an outer face larger than said bore and having an annular first central recess to receive and be retained on the neck portion of the mounting shank, said body having a radial opening from said recess to permit installation of the body on the bit in a motion transverse to the bit axis to cause temporary widening of the opening due to the resilience of the body when said retainer is preloaded onto said groove prior to insertion of said mounting shank into said receiving bore, said radial opening being wide enough to allow circumferential collapsing of said retainer entirely within said first groove, and said first groove being deep enough to receive said retainer in circumferentially collapsed condition during said insertion, means to receive said preloaded retainer in expanded condition after passing through said bore, and a radial shoulder on said inner face of said retainer adjacent said recess for allowing said retainer in expanded condition to lock said shank in said bore.

2. In combination a bit and preload retainer means for mining and construction which comprises:

(a) a mounting block having a receiving bore, (b) a bit having a cutting end and having a mounting shank to be received in the bore of the block and having an annular first groove forming a neck portion on the end of the mounting shank, said bit having a radial surface at the cutting end to limit the inward movement of said bit in a cutting phase, the retainer limiting the outward movement of the bit in a non-cutting phase but permitting axial motion inward and outward within said bore between said phases, (c) said preload retainer comprising:

a generally circular, resilient body with an inner face and an outer face larger than said bore and having an annular first central recess to receive and be retained on the neck portion of the mounting shank, said body having a radial opening from said recess to permit installation of the body on the bit in a motion transverse to the bit axis to cause temporary widening of the opening due to the resilience of the body when said retainer is preloaded onto said groove prior to insertion of said mounting shank into said receiving bore, said radial opening being wide enough to allow circumferential collapsing of the retainer entirely within said first groove, and said first groove being deep enough to receive said retainer in circumferentially collapsed condition during said insertion, means to receive said preloaded retainer in expanded condition after passing through said bore, and a radial shoulder on said inner face of said retainer adjacent said recess for allowing said expanded retainer to lock said shank in said bore, said retainer having an annular ridge on said inner face, radially dimensioned smaller than said radial shoulder to fit into said bore when said retainer is in expanded condition.

3. In combination a bit and preload retainer means for mining and construction which comprises:

(a) a mounting block having a receiving bore, (b) a bit having a cutting end and having a mounting shank to be received in the bore of the block and having an annular first groove forming a neck portion on the end of the mounting shank, said bit having a radial surface at the cutting end to limit the inward movement of said bit in a cutting phase, the retainer limiting the outward movement of the bit in a non-cutting phase but permitting axial motion inward and outward within said bore between said phases, (c) said preload retainer comprising:

a generally circular, resilient body with an inner face and an outer face larger than said bore and having an annular first central recess to receive and be retained on the neck portion of the mounting shank, said body having a radial opening from said recess to permit installation of the body on the bit in a motion transverse to the bit axis to cause temporary widening of the opening due to the resilience of the body when said retainer is preloaded onto said groove prior to insertion of said mounting shank into said receiving bore, said first groove being deep enough to receive said retainer in circumferentially collapsed condition during said insertion, means to receive said preloaded retainer in expanded condition after passing through said bore, and a radial shoulder on said inner face of said retainer adjacent said recess for allowing said expanded retainer to lock said shank in said bore, and (d) a second groove adjacent said first groove having a larger diameter than said first groove, and said retainer having a central opening on said outer face to fit over said second groove to center and stabilize said retainer.

4. In combination a bit and preload retainer means for mining and construction which comprises:

(a) a mounting block having a receiving bore, (b) a bit having a cutting end and having a mounting shank to be received in the bore of the block and having an annular first groove forming a neck portion on the end of the mounting shank, said bit having a radial surface at the cutting end to limit the inward movement of said bit in a cutting phase, the retainer limiting the outward movement of the bit in a non-cutting phase but permitting axial motion inward and outward within said bore between said phases, (c) said preload retainer comprising:

a generally circular, resilient body with an inner face and an outer face larger than said bore and having an annular first central recess to receive and be retained on the neck portion of the mounting shank, said body having a radial opening from said recess to permit installation of the body on the bit in a motion transverse to the bit axis to cause temporary widening of the opening due to the resilience of the body when said retainer is preloaded onto said groove prior to insertion of said mounting shank into said receiving bore, said first groove being deep enough to receive said retainer in circumferentially collapsed condition during said insertion, means to receive said preloaded retainer in expanded condition after passing through said bore, and a radial shoulder on said inner face of said retainer adjacent said recess for allowing said expanded retainer to lock said shank in said bore, said preload retainer having a tapered face on a first surface to cooperate with said bore to collapse said retainer as it is forced into said bore, said bore having outer and inner ends and an annular recess formed within and between the ends of said bore, and cylindrical means retained in the inner end of said bore having an annular surface on an inner end to contact the tapered face of said retainer when projected into said bore to collapse the retainer into said first groove to allow removal of said shank.

5. A combination as defined in claim 4 in which said cylindrical means is closed at its outer end to exclude dust and detritus from said bore and shank.

6. A combination as defined in claim 4 in which said bore recess has first and second shoulders respectively at each end, said retainer in expanded condition contacting one of said shoulders to lock the bit shank in said bore, said cylindrical means having an annular external shoulder at its inner end to contact the other of said recess shoulders to retain said cylindrical means in said bore.

* * * * *